US005850652A

United States Patent [19]

Yamamura et al.

[11] Patent Number: 5,850,652

[45] Date of Patent: Dec. 22, 1998

[54] METHOD OF SUSPENDING BRIDGE-GIRDER OF SUSPENSION BRIDGE

[75] Inventors: Nobumichi Yamamura, Osaka; Hiroshi Tanaka, Neyagawa, both of Japan

[73] Assignee: Hitachi Zosen Corporation, Osaka, Japan

[21] Appl. No.: 750,297

[22] PCT Filed: Mar. 13, 1996

[86] PCT No.: PCT/JP96/00645

§ 371 Date: Feb. 18, 1997

§ 102(e) Date: Feb. 18, 1997

[87] PCT Pub. No.: WO96/31658

PCT Pub. Date: Oct. 10, 1996

[30] Foreign Application Priority Data

Apr. 5, 1995 [JP] Japan ..... 7-079235

[51] Int. Cl.[6] ..... E01D 11/00; E01D 11/02

[52] U.S. Cl. ..... 14/18; 14/21; 14/77.1

[58] Field of Search ..... 14/18, 19, 20, 14/21, 22, 23, 77.1

[56] References Cited

U.S. PATENT DOCUMENTS

| | | | |
|---|---|---|---|
| 509,781 | 11/1893 | Weiss | 14/19 |
| 595,906 | 12/1897 | Dandridge | 14/19 |
| 3,745,601 | 7/1973 | Appelt | 14/19 X |
| 4,866,803 | 9/1989 | Nedelcu | 14/19 |

FOREIGN PATENT DOCUMENTS

| | | | |
|---|---|---|---|
| 58-94707 | 6/1983 | Japan . | |
| 2-243806 | 9/1990 | Japan . | |
| 6-73710 | 3/1994 | Japan | 14/22 |

*Primary Examiner*—James Lisehora

*Attorney, Agent, or Firm*—D. Peter Hochberg

[57] ABSTRACT

A method of suspending a bridge-girder of a suspension bridge is provided. The method is characterized in that where the bridge-girder is suspended by main cables supported by main towers through hanger ropes, the central portion of each of a plurality of horizontal beams mounted on each of the main towers in spaced part relationships with one another vertically are connected to the lateral sides of the bridge-girder by means of obliquely extending auxiliary cables 7. According to this suspension method, the torsional natural frequency of the bridge-girder increases so that the flutters and vortex induced oscillation harmful to the bridge-girder are controlled.

3 Claims, 7 Drawing Sheets

METHOD OF SUSPENDING BRIDGE-GIRDER OF SUSPENSION BRIDGE

TECHNICAL FIELD OF THE INVENTION

The present invention relates to a method of suspending a bridge-girder of a suspension bridge and more particularly to a bridge-girder suspension method capable of controlling the generation of flutters on the bridge-girder.

BACKGROUND TECHNOLOGY

The conventional suspension bridge has been constructed of main towers, cables suspended among the main towers themselves and between the outermost main towers and the lands (or shores) adjacent thereto, respectively, and a bridge-girder extending between the lands (or shores) through the main towers and suspended by the cables through hanger ropes.

That is, the bridge-girder is suspended by main cables through hanger ropes on both sides thereof.

Now, in the case of a huge suspension bridge, the main towers become extremely high so that vortex induced oscillation generates on the bridge and since both sides of the bridge-girder is suspended merely by the hanger ropes, there has arisen the problem that flutters generate on the bridge-girder.

Accordingly, an object of the present invention is to provide a bridge-girder suspension method capable of controlling the flutters and vortex induced oscillation generating on the bridge-girder and towers.

DISCLOSURE OF THE INVENTION

A first aspect of the bridge-girder suspension method according to the present invention resides in that where a bridge-girder is suspended by main cables supported by main towers through hanger ropes, a portion around the center of each of horizontal beams mounted in sequence at a plurality of positions on each of the main towers in the direction of the height thereof and both sides of the bridge-girder are connected by obliquely extending auxiliary cables.

Further, a second aspect of the bridge-girder suspension method according to the present invention resides in that where a bridge-girder is suspended by main cables supported by main towers through the hanger ropes, a portion around the center of each of horizontal beams mounted in sequence at a plurality of positions on each of the main towers in the direction of the height thereof and both sides of the bridge-girder are connected by a plurality of auxiliary cables extending obliquely down to the right side, and a plurality of auxiliary cables extending obliquely down to the left side, of the bridge-girder.

Still further, in the above-mentioned second aspect of the method according to the present invention, the pluralities of right and left auxiliary cables having their first ends connected to each of the horizontal beams are connected to both sides of the bridge-girder, respectively, in such a manner that outer the auxiliary cables are located with respect to the center of each of said horizontal beams, the closer the second ends thereof to the main tower to which the auxiliary cables are attached.

According to the above-described first and second aspects of the bridge-girder suspension method of the present invention, a plurality of auxiliary cables extending obliquely from the central portion of each of the horizontal beams down to the right side, and a plurality of auxiliary cables extending obliquely from the central portion of the horizontal beam down to the left side, of the bridge-girder to thereby suspend the bridge-girder, so that the torsional natural frequency increases and therefore, flutters and vortex induced oscillation harmful to the bridge-girder are controlled.

Further, the horizontal beams arranged vertically along the main tower at predetermined intervals are connected to the bridge-girder by means of the auxiliary cables so that the main tower is restrained and thereby the vortex induced oscillation generating on the main tower is controlled.

BEST MODES FOR WORKING THE INVENTION

The present invention will now be described with reference to the accompanying drawings.

First of all, the first mode of the suspension bridge according to the present invention will be described by referring to FIGS. 1 through 4.

Figure 1:
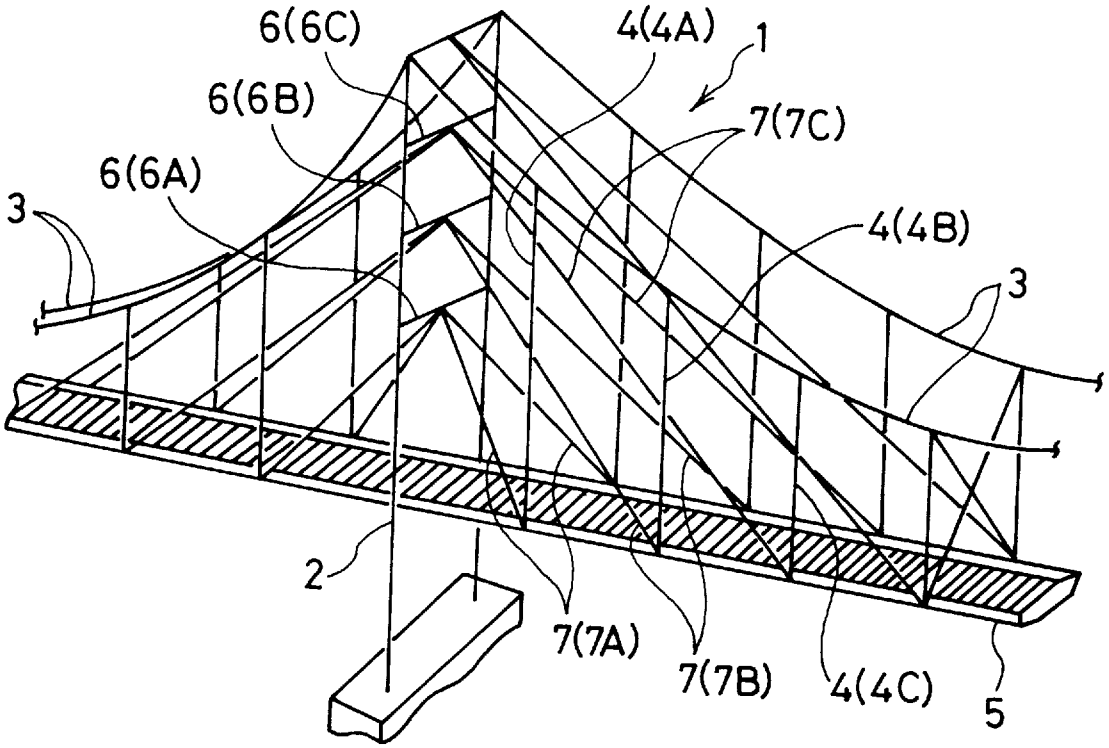
FIG. 1 is a schematic perspective view of a suspension bridge in a first mode according to the present invention.

In FIG. 1, reference numeral 1 designates a suspension bridge which comprises main towers 2, main cables 3 suspended among the main towers 2 and between the outermost ones of the main towers and lands adjacent thereto, respectively, and a bridge-girder 5 extending between the lands through the main towers and suspended by hanger ropes 4 hanging down from the main cables 3 at predetermined intervals.

Further, with respect to the suspension bridge 1, a plurality of horizontal beams 6 are mounted on each of the main towers 2 in spaced apart relationships with each other in the direction of the height of the main towers.

Further, the central portion of each of the horizontal beams 6 and both sides of the bridge-girder 5 are connected by obliquely extending auxiliary cables 7.

That is, the bridge-girder 5 is suspended by the main cables 3 through the hanger ropes 4 and also connected to the main tower 2 through the auxiliary cables 7.

Figure 2:
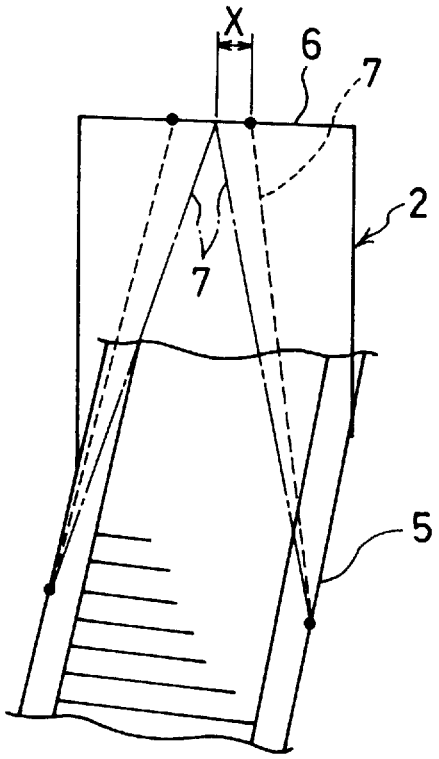
FIG. 2 is a perspective view of an essential part of the suspension bridge in the first mode, the view illustrating how auxiliary cables are arranged.

The auxiliary cables 7 are arranged to form a triangle (truss) as shown in FIG. 2.

Of course, the auxiliary cables 7 are arranged not to intersect each other. For example, auxiliary cables 7A are connected to the connection of a lowermost horizontal beam 6A and the lower end of a hanger rope 4A which is closest to the main tower 2, auxiliary cables 7B are connected to the connection of a horizontal beam 6B which is located second lowest from below and a hanger rope 4B located second closest to the main tower 2, and auxiliary cables 7C are connected to the connection of a horizontal beam 6C located third lowest from below and a hanger rope 4C located third closest to the main tower 2.

As described above, since the intermediate portion of the bridge-girder 5 is connected (suspended) to the main tower 2 by means of a plurality of auxiliary cables 7, the natural frequency in the torsional first symmetrical mode of the bridge-girder 5 increases.

Accordingly, it is possible to control the generation of flutters harmful to the bridge-girder 5.

Further, the above-mentioned flutters include a torsional flutter and a bending-torsion coupled flutter. With either of these flutters, when the natural frequency in the first symmetrical mode increases, the wind velocity resulting therefrom becomes high. In the case of the bending-torsion coupled flutter, the suspension method has such an effect as to increase the frequency ratio between the bending first symmetrical mode and the torsional first symmetrical mode, which contributes to the inhibition of flutters.

Figure 3:
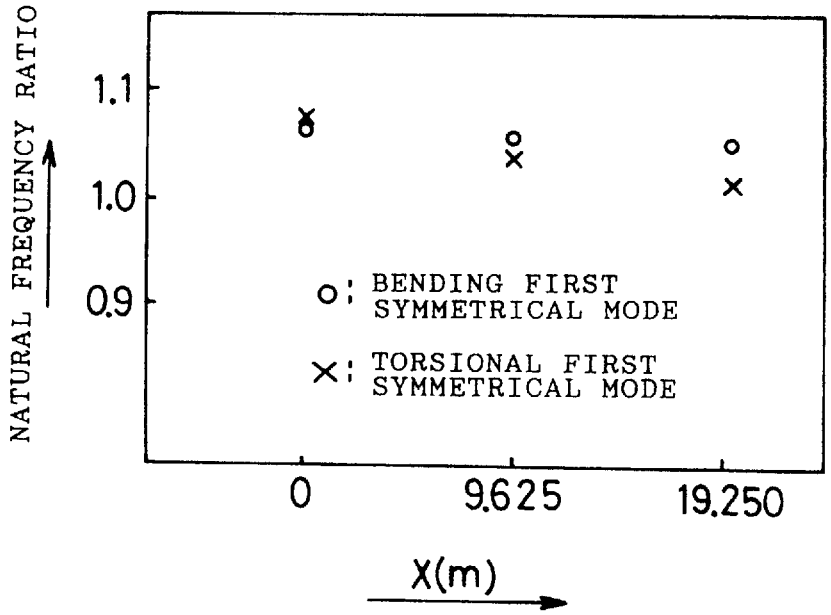
FIG. 3 is a graph showing the natural frequency ratio between the use of suspension by auxiliary cables and the absence of suspension by auxiliary cables with respect to the bending and torsion of a bridge-girder of the suspension bridge in the first mode shown in FIG. 1.

In FIG. 3, there are shown the natural frequency ratios when the connecting position (indicated by x in FIG. 2) of the auxiliary cables 7 and the horizontal beam 6 of the main tower 2 is varied. In FIG. 3, the axis of abscissa shows the distance from the central position of the horizontal beam 6 on the main tower 2 up to the connecting position x of the auxiliary cables 7, and the axis of ordinate shows the natural frequency ratio in the absence of the auxiliary cables 7.

From the graph of FIG. 3 it will be seen that even when the connecting position of the auxiliary cables 7 to the horizontal beam 6 of the main tower 2 is shifted from the central position of the horizontal beam 6, only the natural frequency drops a little and the effect of controlling the flutter can still be expected.

Figure 4:
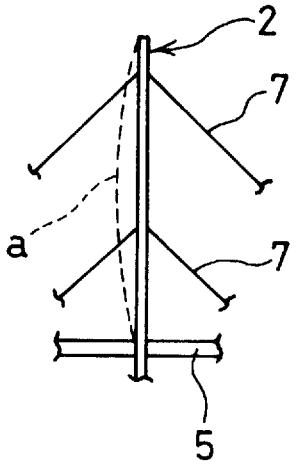
FIG. 4 is an illustration of vortex induced oscillation generating on a main tower of the suspension bridge in the first mode.

Further, since the main tower 2 and the bridge-girder 5 are connected through the auxiliary cables 7 at predetermined intervals in the direction of the height of the main tower 2, the main tower 2 is restrained so that the generation of the vortex induced oscillation as indicated by a broken line (a) in FIG. 4 can be prevented.

Next, the second aspect (mode) of the present invention will be described by referring to FIG. 5.

In the above-described first mode (aspect) of the present invention, two auxiliary cables from each of the horizontal beams are connected to the bridge-girder with one of the cables being connected to the right side, and the other being connected to the left side, of the bridge-girder. However, in the second mode of the present invention, a plurality of (actually two) auxiliary cables from each of the horizontal beams are connected to the right side, and the same number of auxiliary cables from the horizontal beam are connected to the left side, of the bridge-girder.

Figure 5:
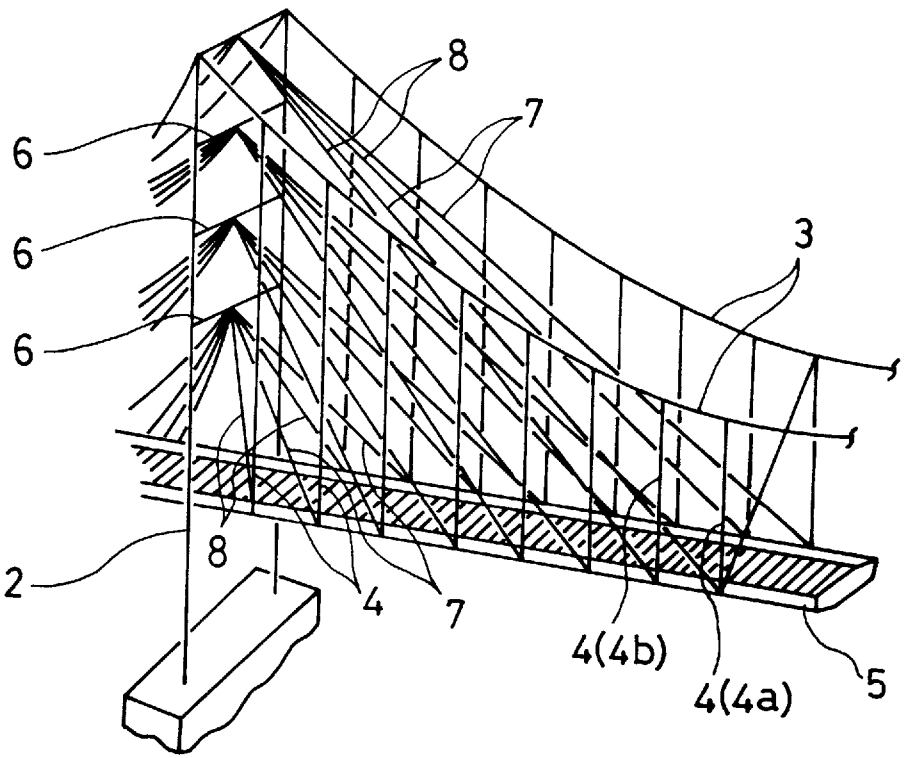
FIG. 5 is a perspective view of an essential part of a suspension bridge in a second mode according to the present invention.

That is, as shown in FIG. 5, there are provided two right-side auxiliary cables 7 and two left-side auxiliary cables 8 having their first ends connected to the central portion of each of the horizontal beams 6 on the main tower 2.

Further, the second ends of these auxiliary cables 7 and 8 are connected to both sides of the bridge-girder 5 in such a manner that, as the first ends of the auxiliary cables leave away from the center of the horizontal beam 6 to which they are attached, they are connected to the bridge-girder at positions closer to the main tower 2 at positions where the hanger ropes 4 are attached.

For example, in FIG. 5, the fixing position of the second end of one of the auxiliary cables 8 located outside the center of the horizontal beam 6 is located at the fixing position of the hanger rope 4*a* which is closer to the main tower 2 than the connecting position (the fixing position of the hanger rope 4*a*) of the second end of the other of the auxiliary cables 7 located toward the center of the horizontal beam 6.

Figure 6:
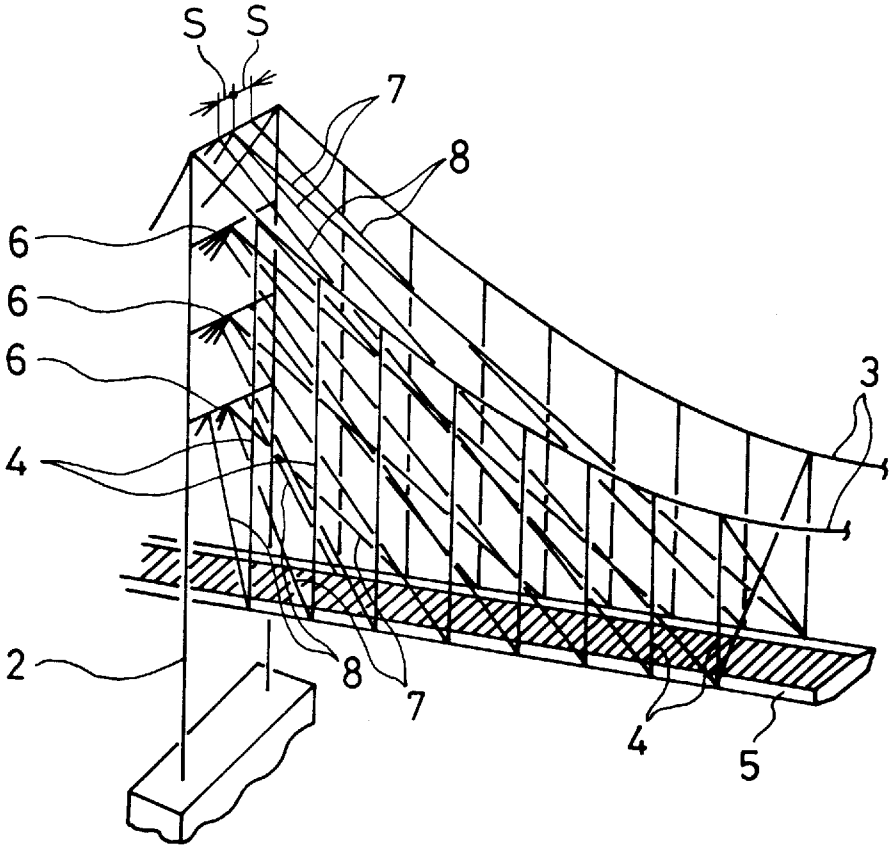
FIG. 6 is a perspective view of an essential part of a suspension bridge as a variation of the suspension bridge in the second mode.
Figure 7:
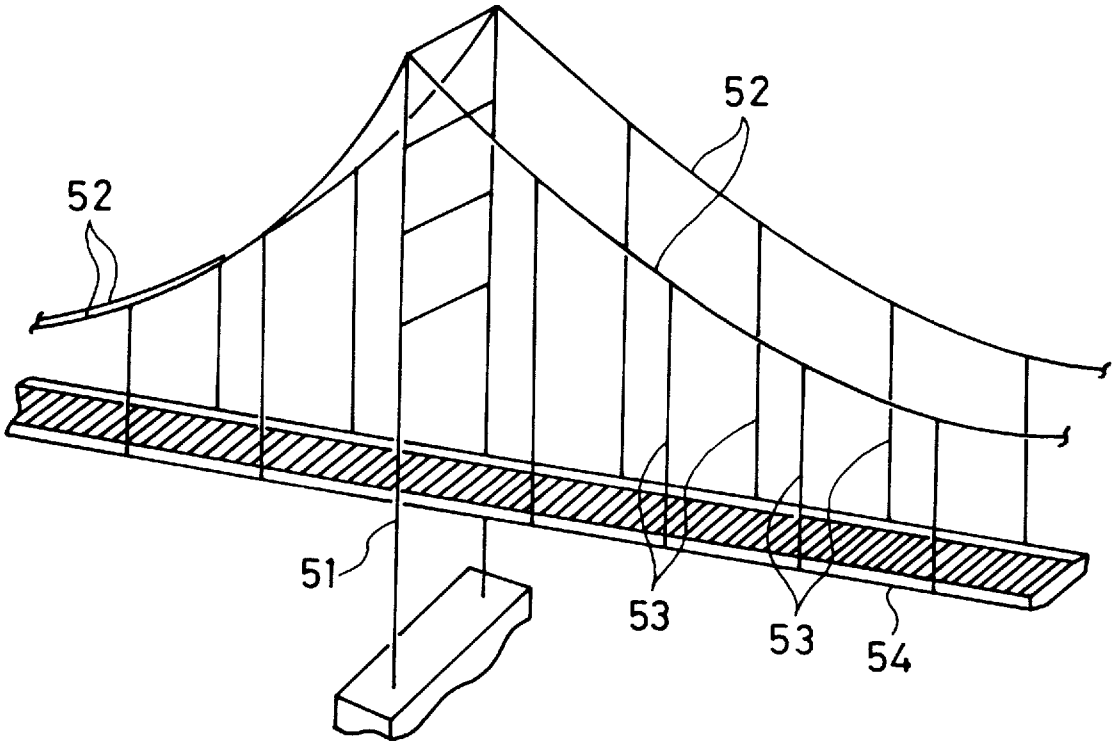
FIG. 7 is a schematic perspective view of a conventional suspension bridge.

Further, as shown in FIG. 6, the two auxiliary cables 7 and 8 provided for each of the right and left sides of the bridge-girder 5 may be spaced apart from each other by a predetermined distance s.

In the above manner, where a plurality of auxiliary cables 7 and 8 for connecting the horizontal beam 6 and each side of the bridge-girder 5, an effect greater than the flutter controlling effect by the first mode of the present invention can be obtained.

According to the above-described bridge-girder suspension method, since the bridge-girder is suspended by the auxiliary cables extending from a portion around the center of each of the horizontal beams mounted on the main tower toward both sides of the bridge-girder, the torsional natural frequency increases and accordingly, it is possible to control the flutters and vortex induced oscillation harmful to the bridge-girder.

Further, since the horizontal beams arranged in spaced apart relationships with one another in the direction of the height of the main tower are connected to the bridge-girder by means of the auxiliary cables, the main tower is restrained and accordingly, vortex induced oscillation generating on the main tower can be controlled.

Still further, even where pluralities of auxiliary cables are arranged both right and left sides, respectively, the same or more effect can be obtained therefrom.

POSSIBILITY OF INDUSTRIAL USE

As described above, the method of suspending a bridge-girder of a suspension bridge according to the present invention is suitable for suspending the bridge-girder of a huge suspension bridge having tall main towers and accompanied with a flutter and vortex induced oscillation on the bridge-girder.

What is claimed is:

1. A method of suspending a bridge girder of a suspension bridge wherein the bridge comprises a right vertical tower and a left vertical tower, the right vertical tower and the left vertical tower holding a right main cable and a left main cable respectively, a plurality of hanger ropes hanging from the respective main cables at predetermined intervals, the bridge girder being suspended from the right main cable and the left main cable through the hanger ropes, and horizontal beams extending in the width direction between the right tower and the left tower in sequence at a plurality of positions vertically along the height of the towers;

comprising connecting by means of obliquely extending auxiliary cables, a portion around the center of the respective horizontal beams, and a portion around the connecting position of the respective hanger ropes on both sides of the bridge girder.

2. A method of suspending a bridge girder of a suspension bridge wherein the bridge comprises a right vertical tower and a left vertical tower, the right vertical tower and the left vertical tower holding a right main cable and a left main cable respectively, a plurality of hangers ropes hanging from the respective main cables at predetermined intervals, the bridge girder being suspended from the right main cable and the left main cable through the hanger ropes, and horizontal beams extending in the width direction between the right tower and the left tower in sequence at a plurality of portions vertically along the height of the towers;

comprising connecting by a plurality of auxiliary cables extending between a portion around the center of each of the horizontal beams and obliquely down to the right side of the bridge girder, and by a plurality of auxiliary cables extending between a portion around the center of each of the horizontal beams and obliquely down to the left side of the bridge girder.

3. A method of suspending a bridge girder of a suspension bridge according to claim 2, comprising separating towards the right and left towers, respectively, the connection of the auxiliary cables at the respective horizontal beams, to obtain the same or greater flutter controlling effect than if the connection of the auxiliary cables at the respective horizontal beams were less separated toward the right tower and the left tower, respectively.

* * * * *